US006871575B2

(12) United States Patent
Korogi

(10) Patent No.: US 6,871,575 B2
(45) Date of Patent: Mar. 29, 2005

(54) HYDRAULIC CONTROL APPARATUS FOR CONTROLLING HYDRAULIC CYLINDER FOR IMPLEMENT

(75) Inventor: Isao Korogi, Sakai (JP)

(73) Assignee: Kubota Corporation, Osaka (JP)

( * ) Notice: Subject to any disclaimer, the term of this patent is extended or adjusted under 35 U.S.C. 154(b) by 31 days.

(21) Appl. No.: 10/400,160

(22) Filed: Mar. 26, 2003

(65) Prior Publication Data

US 2004/0182233 A1 Sep. 23, 2004

(30) Foreign Application Priority Data

Mar. 19, 2003 (JP) ..... 2003-075261

(51) Int. Cl.[7] ..... F15B 13/04
(52) U.S. Cl. ..... 91/436; 137/636.2
(58) Field of Search ..... 91/436, 437, 439; 60/494; 137/636.2, 553, 556, 556.3, 556.6

(56) References Cited

U.S. PATENT DOCUMENTS 3,965,587 A * 6/1976 Johns, Jr. ..... 91/436
4,955,282 A * 9/1990 Ranson ..... 91/436

FOREIGN PATENT DOCUMENTS

JP (1997) 9-316915 A 9/1997

* cited by examiner

*Primary Examiner*—F. Daniel Lopez
*Assistant Examiner*—Michael Leslie
(74) *Attorney, Agent, or Firm*—Webb Ziesenheim Logsdon Orkin & Hanson, P.C.

(57) ABSTRACT

A hydraulic control apparatus for controlling a hydraulic cylinder for an implement selectively mounted to a work vehicle. The apparatus includes a hydraulic power source, a four-position changeover control valve disposed between the hydraulic cylinder and the hydraulic power source, and an operational mechanism for operating the four-position changeover control valve. The four-position changeover control valve has a first position for moving a rod of the hydraulic cylinder in one direction, a second position for stopping the rod of the hydraulic cylinder, a third position for moving the hydraulic cylinder rod at a high speed in the other direction with using a function of a regenerative circuit and a fourth position for moving the hydraulic cylinder rod in the other direction at a standard speed without using the function of the regenerative circuit, in the mentioned order. The operational mechanism includes, along an operational movement path thereof, a rollback position, a neutral position, a rapid dump position and a standard dump position, the rollback position corresponding to the first position, the neutral position corresponding to the second position, the rapid dump position corresponding to the third position, the standard dump position corresponding to the fourth position, respectively.

8 Claims, 6 Drawing Sheets

HYDRAULIC CONTROL APPARATUS FOR CONTROLLING HYDRAULIC CYLINDER FOR IMPLEMENT

BACKGROUND OF THE INVENTION

1. Field of the Invention

The present invention relates to a hydraulic control apparatus for controlling a hydraulic cylinder for an implement selectively mounted on a work vehicle.

2. Description of the Related Art

An example of a work vehicle using the above-noted type of hydraulic control apparatus is a tractor type front loader. For instance, in the case of such front loader known from Japanese Patent Application "Kokai" No.: Hei. 9-316915, a boom to which a bucket is pivotally attached is mounted to a tractor frame. And, a boom cylinder for lifting up/down this boom and a bucket cylinder for pivoting the bucket are controlled by hydraulic control valves provided respectively therefor. In this case, the hydraulic control valve for the bucket cylinder is constructed as a three-position changeover control valve having a rollback position, a neutral position and a dump position. Further, at the dump position, there is formed a so-called "regenerative circuit" in which a return pressure oil discharged from the bucket cylinder is combined with feed pressure oil to the bucket cylinder. Hence, this dump position functions as a rapid dump position. In this rapid dump arrangement using a regenerative circuit, the bottom of the bucket cylinder is rapidly filled with pressure oil, resulting in a rapid pivotal movement of the bucket for facilitating removal of sticky or viscous soil and sand from the bucket. In this way, the three-position changeover control valve is convenient for controlling a bucket. However, when a different implement other than a bucket is attached, such rapid cylinder movement may deteriorate the control convenience, rather than improve it. However, if such other implement is driven not by a hydraulic cylinder, but by a hydraulic motor, there may occur critical failure of the hydraulic motor being disabled at all by the function of the regenerative circuit which renders the pressure at the IN port equal to that of the OUT port. Therefore, the three-position changeover control valve is not suitable as a changeover control valve in a case where a variety of implements can be selectively attached to the work vehicle.

In order to solve this problem, as shown in FIG. 7, for controlling a bucket cylinder 15, there has been proposed to employ a four-position changeover control valve 400 constructed by adding a rapid dump position RD supplemented with a regenerative circuit as a fourth position to the conventional three-position changeover control valve having a rollback position RB, a neutral position N and a dump position SD. With this four-position changeover control valve 400, however, when an operator manipulating a bucket for dumping its load simply operates this control valve from the neutral position to the dump position adjacent thereto, the bottom of the bucket cylinder 15 may not be filled with the pressure oil because the velocity of the oil is insufficient for the movement of the piston cylinder. Further, when the control valve is returned from the dump position to the rollback position after completion of the dump operation, the bucket will not be moved until the bottom of the bucket cylinder 15 is filled with the pressure oil. Therefore, in dumping load from the bucket, the operator needs to operate the control lever from the neutral position to the rapid dump position directly, passing the dump position. At the rapid dump position, the bottom of the bucket cylinder 15 is rapidly filled with the pressure oil, whereby sticky and viscous soil and sand or the like can be readily removed from the bucket. However, since the operator needs to operate the control lever from the neutral position to the rapid dump position directly, passing the dump position, the operator will suffer from inconvenience if he/she has to effect in repetition the above operation for operating the control lever from the neutral position to the rapid dump position directly, passing the dump position. Incidentally, in FIG. 7, numeral 300 denotes a four-position changeover valve for controlling a boom cylinder 14, having an UP position, a neutral position N, a down position D and a floating position F.

SUMMARY OF THE INVENTION

In view of the above-described state of the art, a primary object of the present invention is to provide a hydraulic control apparatus for a hydraulic cylinder for an implement in a construction which at least allows selective mount of the implement on a work vehicle, the apparatus providing superior controllability for a bucket in particular.

For accomplishing the above-noted object, according to the present invention, a hydraulic control apparatus for controlling a hydraulic cylinder for an implement selectively mounted to a work vehicle, comprises a hydraulic power source, a four-position changeover control valve disposed between the hydraulic cylinder and the hydraulic power source, and an operational mechanism for operating the four-position changeover control valve;

wherein the four-position changeover control valve has a first position for moving a rod of the hydraulic cylinder in one direction, a second position for stopping the rod of the hydraulic cylinder, a third position for moving the hydraulic cylinder rod at a high speed in the other direction with using a function of a regenerative circuit and a fourth position for moving the hydraulic cylinder rod in the other direction at a standard speed without using the function of the regenerative circuit, in the mentioned order;

the operational mechanism includes, along an operational movement path thereof, a rollback position, a neutral position, a rapid dump position and a standard dump position, the rollback position corresponding to the first position, the neutral position corresponding to the second position, the rapid dump position corresponding to the third position, the standard dump position corresponding to the fourth position, respectively.

With the above-described construction, both on the spool arrangement of the control valve and the operational path arrangement of the operational mechanism for the control valve, the third position (rapid dump position) suitable for a bucket operation where the regenerative circuit (the circuit combing the return pressure oil from the hydraulic cylinder with the feed pressure oil to the hydraulic cylinder) and the first position (rollback position) are disposed side by side across the second position (neutral position). Hence, this construction provides greater convenience when changeover operations between these positions are to be effected repeatedly. And, when an implement not using the regenerative circuit is attached to the vehicle, the first position (rollback position), the second position (neutral position) and the fourth position (standard dump position) will be used. In this case, the changeover operation between the neutral position (second position) and the standard dump position (fourth position) will be effected with passing the rapid dump position. Yet, this will provide substantially no inconvenience in a mode of work not requiring rapid feeding of pressure oil utilizing the regenerative circuit, since the disengaging operation of the changeover control valve is not so frequently effected in general in such mode of work.

A typical example of such mode of work requiring rapid feeding of pressure oil with utilizing the regenerative circuit is a bucket work. Then, according to a preferred embodiment of the present invention, the implement comprises a front loader to be mounted on a tractor as the work vehicle. In place of a bucket, the tractor is capable of mounting thereon a further implement such as a snow blower to be controlled by the four-position changeover control valve.

Further, in the case of the above-described construction, there are provided the two changeover positions of the third position (rapid dump position) and the fourth position (standard dump position) for moving the cylinder rod in one direction, and in particular, the third position (rapid dump position) involves the special flow of the pressure oil. Then, in order to allow an operator's recognition of this fact, according to another preferred embodiment of the present invention, said four-position changeover control valve and/or the operational mechanism has a detent function for providing the operator with a distinct operational feel at the third position or the rapid dump position. With this detent function, the operator can recognize with a distinct operational feel such as a click feel indicating that the apparatus has been operated to the third position (rapid dump position).

In order to prevent the operator from erroneously or inadvertently operating the apparatus into the fourth position (standard dump position) when the operator carries out a work with repeated changeovers among the first position (rollback position), the second position (neutral position) and the third position (rapid dump position), according still another preferred embodiment of the present invention, said operational mechanism includes a stopper plate for limiting, when necessary, the operational path of the mechanism to the rollback position, the neutral position and the rapid dump position. Advantageously, the stopper plate is a pivotal member which can be laid over the operational path when needed.

Further and other features and advantages of the present invention will become apparent from the following detailed description of the preferred embodiments thereof with reference to the accompanying drawings.

DESCRIPTION OF THE PREFERRED EMBODIMENTS

Figure 1:
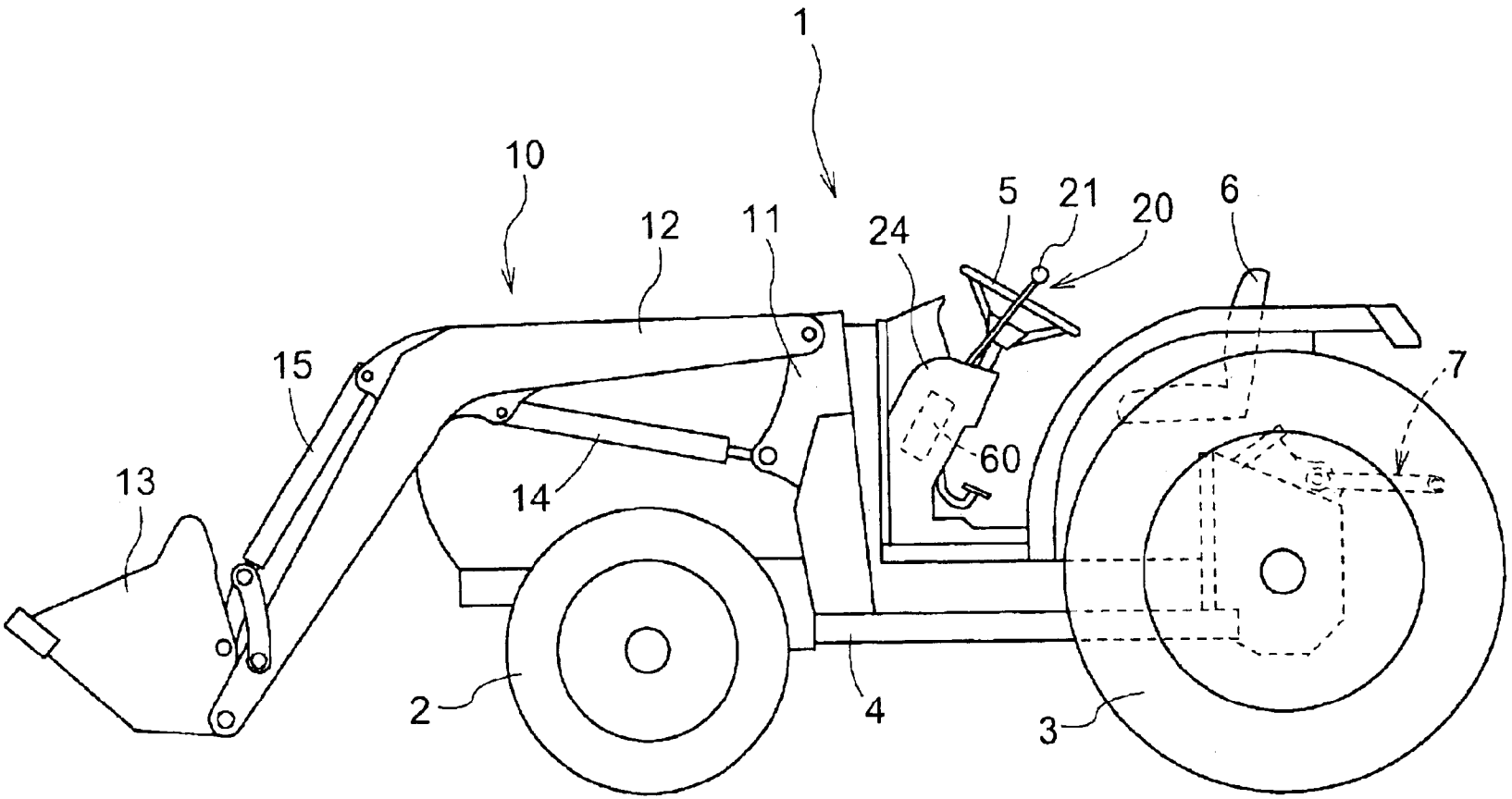
FIG. 1 is a side view showing a tractor employing a hydraulic control apparatus of the invention and mounting a front loader.

FIG. 1 shows a tractor 1 using a hydraulic control apparatus relating to the present invention and mounting a front loader 10 as a bucket operating implement. The tractor 1 includes front wheels 2, rear wheels 3 and a tractor vehicle body 4 supported on the ground surface by the front and rear wheels 2, 3. And, on the tractor vehicle body 4, there are mounted such components as an engine (not shown), a steering wheel 5, an operator's seat 6, a three-point link mechanism 7 for a cultivating machine, etc.

The front loader 10 includes masts 11 attached respectively to a pair of right and left mounts provided on opposed sides of the tractor vehicle body 4, a boom 12 pivoted to the masts 11 to be vertically pivotable, a bucket 13 pivotally attached to the leading end of the boom 12, a boom cylinder 14 for vertically pivoting the boom 12 and a bucket cylinder 15 for pivoting the bucket 13 between a roll back position and a dump position.

The tractor 1 mounting such front loader 10 described above functions as a front loader vehicle capable of such works as loading/dumping sand, soil, compost and transporting the same. Further, by mounting a different implement such as a snow blower to the tractor instead of the bucket front loader 10, the tractor will be able to carry out different types of work.

For hydraulically operating and controlling the mounted implement, i.e. the front loader implement 10 in this particular case, the tractor 1 includes the hydraulic control apparatus. This hydraulic control apparatus includes an operational mechanism 20 operable by an operator and a hydraulic circuit shown in FIG. 2.

Figure 2:
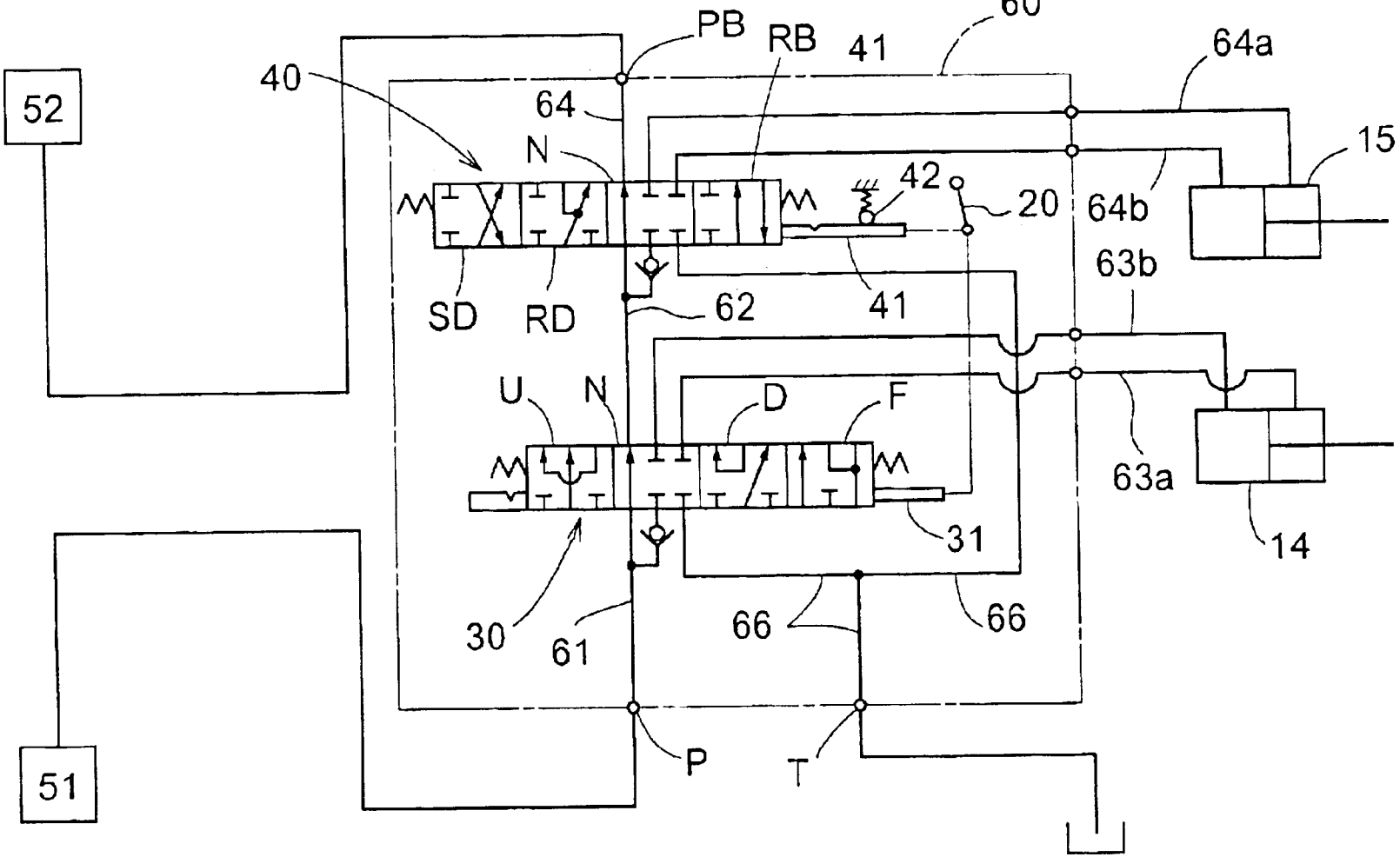
FIG. 2 is a hydraulic circuit diagram of the hydraulic control apparatus.

As may be apparent from FIG. 2, the hydraulic circuit incorporates the boom cylinder 14, the bucket cylinder 15, a four-position changeover control valve (referred to simply as "boom control valve" hereinafter) 30 for the boom cylinder 14, a four-position changeover control valve (referred to simply as "bucket control valve" hereinafter) 40 for the bucket cylinder 15, a hydraulic pump unit 51 driven by the engine of the tractor 1, and a three-point link hydraulic unit 52 included in the three-point link mechanism described above. The boom control valve 30 and the bucket control valve 40 are incorporated in a valve unit 60 including a casing having a tank port T, a pump port P and a port block PB. And, a spool 31 of the boom control valve 30 and a spool 41 of the bucket control valve 40 extend in parallel with each other. Incidentally, in the bucket control valve 40, there is formed a regenerative circuit which per se is well-known. Inside the valve unit 60, the boom control valve 30 and the bucket control valve 40 are connected in series with the boom control valve 30 being positioned adjacent the pump. Specifically, there are formed an oil passage 61 connecting the pump port P to the primary side of the boom control valve 30, an oil passage 62 connecting the secondary side of the boom control valve 30 to the primary side of the bucket control valve 40, oil passages 63*a*, 63*b* connecting the secondary side of the boom control valve 30 to the boom cylinder 14, an oil passage 64 connecting the secondary side of the boom control valve 40 to the port block PB, oil passages 64*a*, 64*b* connecting the secondary side of the bucket control valve 40 to the bucket cylinder 15 and a common oil passage 66 connecting the primary sides of the boom control valve 30 and the bucket control valve 40 to the tank port T.

The boom control valve 30 has, as control changeover positions thereof, an UP position U, a neutral position N, a DOWN position D, and a floating position F. At the UP position U, the oil passage 61 is communicated with the bottom side oil passage 63*b* of the boom cylinder 14 and the top side oil passage 63*a* is communicated with the oil passage 62. At the neutral position N, the communication between the oil passage 61 and the oil passages 63*a*, 63*b* is blocked and the oil passage 61 is communicated with the oil passage 62. At the DOWN position D, the oil passage 61 is communicated with the top side oil passage 63*a* of the boom cylinder 14 and the bottom side oil passage 63*b* of the boom cylinder 14 is communicated with the oil passage 62. At the floating position F, the communication between the oil passage 61 and the oil passages 63*a*, 63*b* is blocked and the oil passage 61 is communicated with the oil passage 62, and at the same time, both the oil passages 63*a*, 63*b* are opened to the oil passage 66.

The bucket control valve 30 has a rollback position RB as a first control changeover position, a neutral position N as a second control changeover position, a rapid dump position RD as a third control changeover position and a standard dump position SD as a fourth control changeover position. At the rollback position RB, the oil passage 62 is communicated with the oil passage 64 and the top side oil passage 64*a* of the bucket cylinder 14 is communicated with the oil passage 62 and also the bottom side oil passage 64*b* of the bucket cylinder 14 is opened to the oil passage 66. With this, the rod of the bucket cylinder 14 is retracted to set the bucket 13 to a posture for scooping e.g. sand or soil. At the neutral position N, the communication between the oil passage 62 and the oil passages 64*a*, 64*b* is blocked and the oil passage 62 is communicated with the oil passage 64. In this case, since the oil passages 64*a*, 64*b* are blocked, the bucket 13 maintains its posture. At the rapid dump position RD, the oil passage 62 is communicated with the bottom side oil passage 64*b* of the bucket cylinder 14, and also due to the function of the regenerative circuit, the pressure oil discharged from the bottom side oil passage 64*b* of the bucket cylinder 14 is converged with this bottom side oil passage 64*b*. With this, the rod of the bucket cylinder 14 is rapidly extracted to set the bucket 13 into a posture for rapidly dumping the sand, soil or the like. At the standard dump position SD, the oil passage 62 is communicated with the bottom side oil passage 64*b* of the bucket cylinder 14 and also the top side oil passage 64*a* of the bucket cylinder 14 is opened to the oil passage 66. Accordingly, in this case, without the above-described additional hydraulic control provided by the regenerative circuit, the rod of the bucket cylinder 14 is extracted at a standard speed to set the bucket 13 to the posture for dumping the sand, soil or the like. However, in a bucket operation of the operation of the front loader as employed in this embodiment, the standard dump position SD is not used, but the rapid dump position RD is used instead for the following reason. Namely, by shifting the control valve 40 from the rollback position to the rapid dump position, the bottom of the bucket cylinder 14 will be filled with the pressure oil quickly, so that the load within the bucket will be dumped rapidly so as to facilitate removal of sticky or viscous load such as viscous soil from the bucket 13.

Moreover, advantageously with the bucket control valve 30 employed in the present invention, with each operational displacement of its spool in one direction, the valve is changed over one after another in the order of: rollback position RB—neutral position N—rapid dump position RD—standard dump position SD. And, with each operational displacement of the spool in the other (opposite) direction, the valve is changed over one after another in the reverse order of: standard dump position SD—rapid dump position RD—neutral position N—rollback position RB. That is to say, in a front loader operation not using the standard dump position SD, by frequently switching over the bucket control valve 30 between rollback position RB—neutral position N—rapid dump position RD, the scooping and dumping operations of the soil or the like will be carried out in repetition. In this way, the convenience of the operation is improved.

In case an implement other than the front loader 10, e.g. an implement using a hydraulic motor, is mounted on the vehicle, the first position (rollback position RB), the second position (neutral position N) and the fourth position (standard dump position SD) will be used. With such implement, the changeover between the first position and the fourth position is not effected. Hence, even though the third position (rapid dump position RD) is present therebetween, this will not significantly affect the operation.

As described above, the front loader operation requires only the changeover between the rollback position RB—neutral position N—rapid dump position RD and there is no need for the changeover to the standard dump position SD. And, in order to avoid erroneous or inadvertent displacement of the spool 41 to the standard dump position SD, there is provided a detent mechanism 42 operable at the rapid dump position RD. Such detent mechanism per se is well-known. And, this mechanism can comprise e.g. a recess formed in the spool 41 and a ball urged toward this recess by means of a spring. This detent mechanism 41 can be provided in a place different from the spool 41. For instance, it may be provided in the operational mechanism 20 of the hydraulic control apparatus to be described below.

Figure 3:
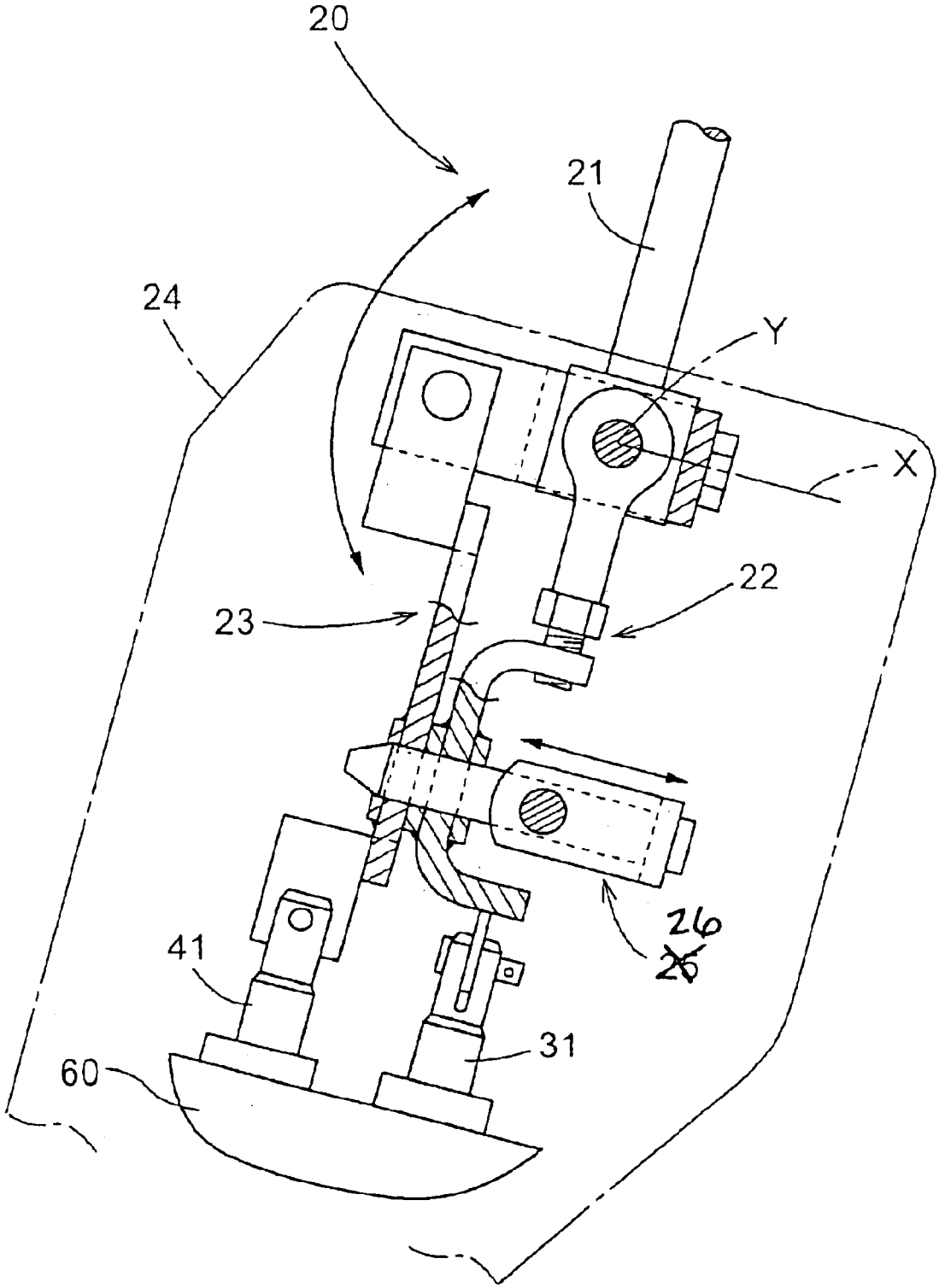
FIG. 3 is an exploded view showing an operational mechanism included in the hydraulic control apparatus.
Figure 4:
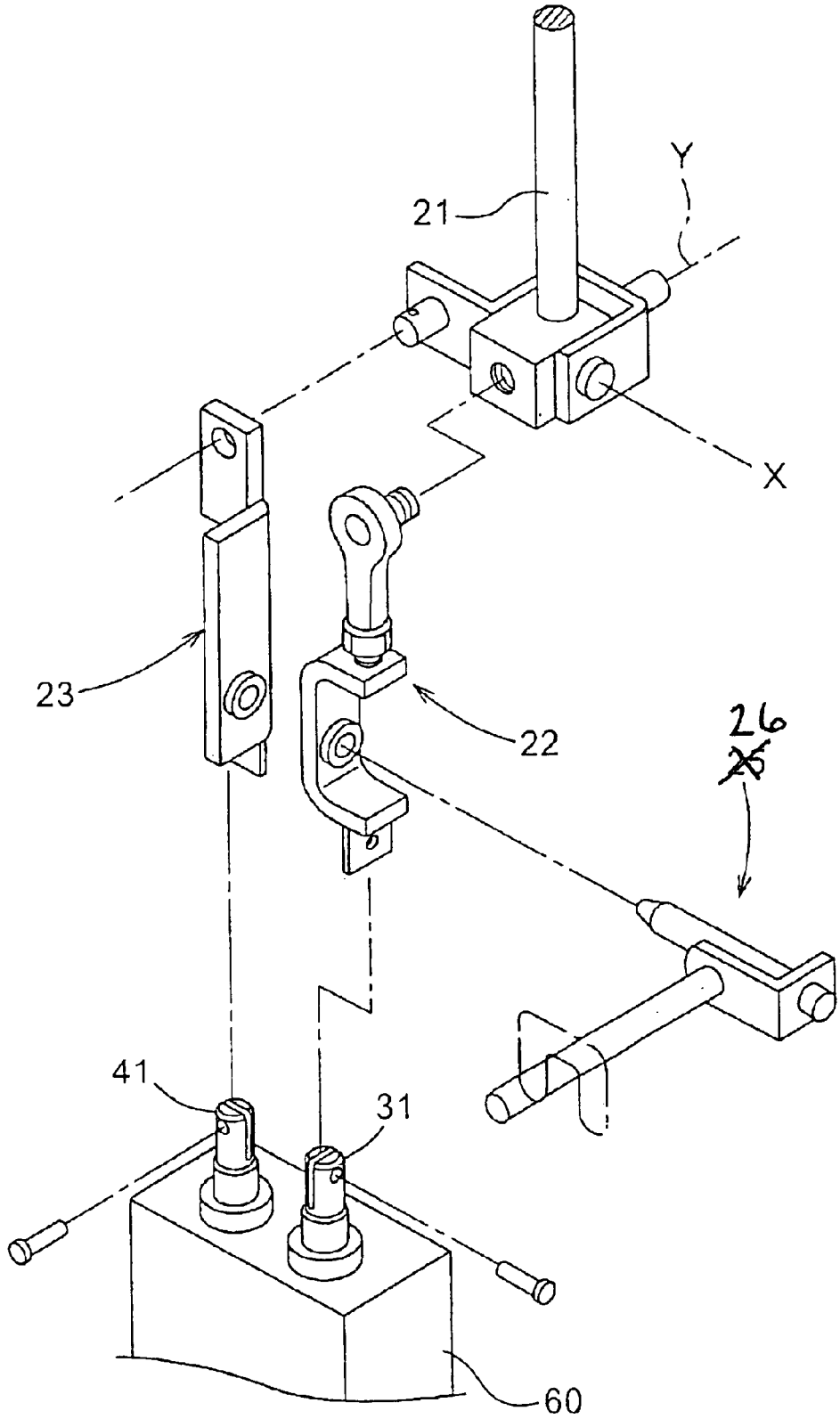
FIG. 4 is an enlarged view showing a portion of the operational mechanism.
Figure 5:
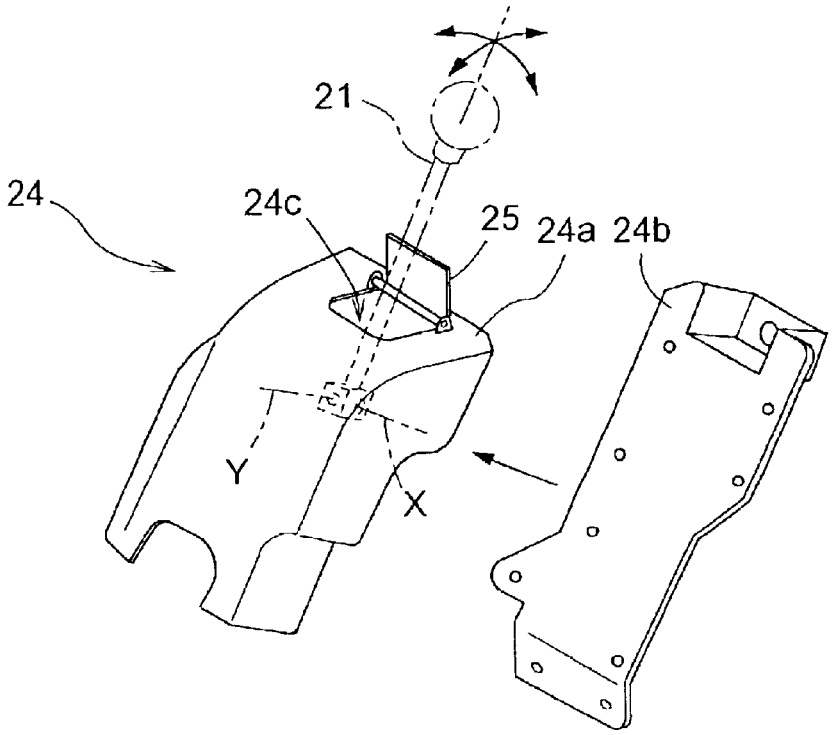
FIG. 5 is an exploded view showing a housing of the operational mechanism.

Namely, the operational mechanism 20 of the hydraulic control apparatus, in this case, an operational mechanism 20 for the boom control valve 30 and the bucket control valve 40, is shown in FIG. 3, FIG. 4 and FIG. 5. This operational mechanism 20 includes a control lever 21 pivotable about an X axis and also an Y axis normal thereto, a first link mechanism 22 for transmitting a pivotal displacement of the control lever 21 about the X axis as a linear displacement for the spool 31 of the boom cylinder 30, a second link mechanism 23 for transmitting a pivotal displacement of the control lever 21 about the Y axis as a linear displacement for the spool 41 of the bucket cylinder 40, and a lock mechanism 26 for locking the movements of these link mechanisms 22, 23. In the vicinity of the operator's seat 6, there is provided a control post 24 acting as a mount for this operational mechanism 20, the valve unit 60 etc. This control post 24 includes such members as a base plate 24*a* and a post housing 24*b*.

Figure 6:
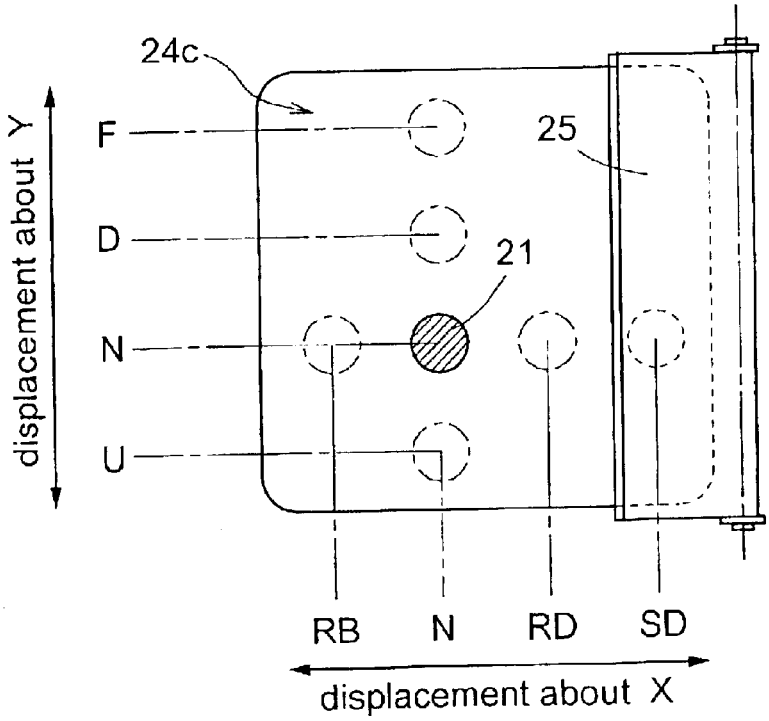
FIG. 6 is an explanatory view showing an operational displacement range of a control lever.
Figure 7:
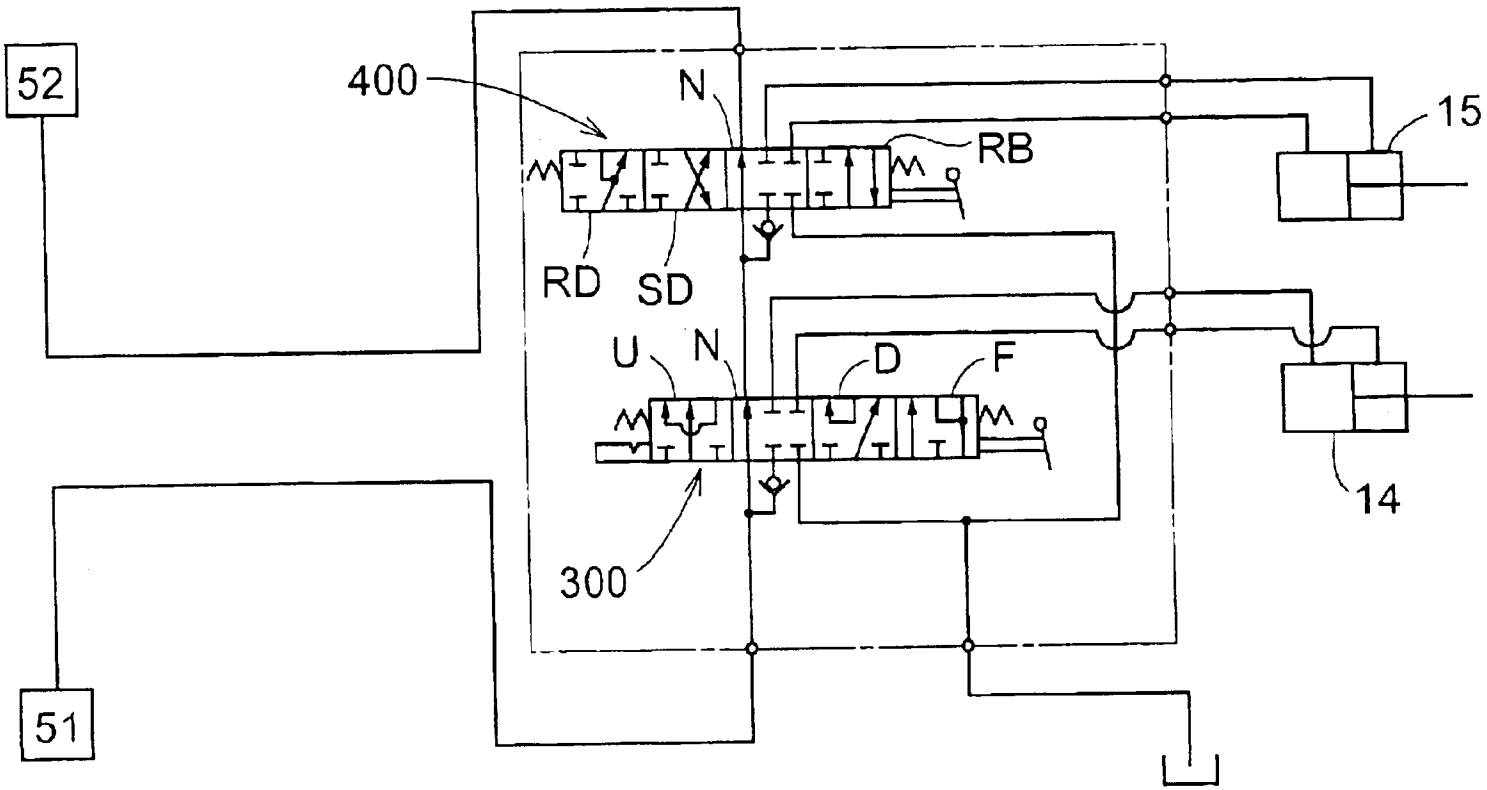
FIG.7 PRIOR ART
FIG. 7 is a hydraulic circuit diagram of a hydraulic control apparatus for a front loader as the prior art.

In the top face of the post housing 24*b*, there is formed an opening 24*c* through which the control lever 21 projects. The control lever 21, as shown schematically in FIG. 6, is movable, within the opening 24*c*, to various positions corresponding to all of the changeover positions of the boom cylinder 30 and to all of the changeover positions of the bucket cylinder 40. Incidentally, adjacent the opening 24*c*, there is provided a stopper plate 25 which is constructed as a pivotal flat in this particular embodiment. In operation, by pivoting this stopper plate 25 so as to cover a portion of the opening 24*c*, the control lever 21 is prevented from being shifted to the standard dump position SD as the fourth changeover position. That is to say, in the case of the front loader operation described above, by pivoting the stopper plate 25 into the operative position, the changeover operations of the bucket cylinder 40 by the operations of the control lever 21 will be limited to the rapid dump position RD—neutral position N—the rollback position RB. Hence, the convenience of the operation is improved. Instead of the pivotal type described above, the stopper plate 25 may be provided as a slide type. Or, it may be a type to be fitted within the opening 24*c* when necessary.

In these manners, the invention may be embodied in any other manner as described above. Further changes or modifications will be apparent for those skilled in the art from the foregoing disclosure within the scope of the invention defined in the appended claims.

What is claimed is:

1. A hydraulic control apparatus for controlling a hydraulic cylinder for an implement selectively mounted to a work vehicle, comprising:

a hydraulic power source;

a four-position changeover control valve disposed between the hydraulic cylinder and the hydraulic power source; and an operational mechanism for operating the four-position changeover control valve;

wherein the four-position changeover control valve has a first position for moving a rod of the hydraulic cylinder in one direction, a second position for stopping the rod of the hydraulic cylinder, a third position for moving the hydraulic cylinder rod at a high speed in the other direction with using a function of a regenerative circuit and a fourth position for moving the hydraulic cylinder rod in the other direction at a standard speed without using the function of the regenerative circuit, in the mentioned order;

the operational mechanism includes, along an operational movement path thereof, a rollback position, a neutral position, a rapid dump position and a standard dump position, the rollback position corresponding to the first position, the neutral position corresponding to the second position, the rapid dump position corresponding to the third position, the standard dump position corresponding to the fourth position, respectively, and said operational mechanism includes a stopper plate for limiting the operational path of the mechanism to the rollback position, the neutral position and the rapid dump position.

2. The hydraulic control apparatus according to claim 1, wherein the implement comprises a front loader to be mounted on a tractor as the work vehicle.

3. The hydraulic control apparatus according to claim 1, wherein said four-position changeover control valve and/or the operational mechanism has a detent mechanism for providing the operator with a distinct operational feel at the third position or the rapid dump position.

4. A hydraulic control apparatus for controlling a hydraulic actuator for a front loader mounted to a tractor, the front loader having a bucket, the apparatus comprising:

a hydraulic power source;

a four-position changeover control valve disposed between the hydraulic actuator and the hydraulic power source, the four-position changeover control valve including a spool extending and displaceable longitudinally therethrough; and an operational mechanism for operating the four-position changeover control valve;

wherein the four-position changeover control valve has a first position for moving a rod of the hydraulic actuator in one direction, a second position for stopping the rod of the hydraulic actuator, a third position for moving the hydraulic actuator rod at a high speed in the other direction with using a function of a regenerative circuit and a fourth position for moving the hydraulic actuator rod in the other direction at a standard speed without using the function of the regenerative circuit, in the mentioned order;

the operational mechanism includes, along an operational movement path thereof, a rollback position, a neutral position, a rapid dump position and a standard dump position, the rollback position corresponding to the first position, the neutral position corresponding to the second position, the rapid dump position corresponding to the third position, the standard dump position corresponding to the fourth position, respectively, and the four-position changeover control valve has a detent mechanism for providing the operator with a distinct operational feel at the third position thereof, the detent mechanism including a recess defined in the spool and a ball urged to engage the recess.

5. The hydraulic control apparatus according to claim 1, wherein:

said hydraulic actuator comprises a bucket actuator for effecting rolling back and dumping operations of said bucket, and when the front loader is mounted to the tractor, the bucket is operated through the bucket actuator by operating the four-position changeover control valve among the three positions consisting of the rollback position, the neutral position and the rapid dump position without using the standard dump position.

6. A hydraulic control apparatus for controlling respective hydraulic actuators for a first implement and a second implement selectively mounted to a tractor, comprising:

a hydraulic power source;

a four-position changeover control valve disposed between the hydraulic actuator and the hydraulic power source, wherein the four-position changeover control valve has a first position for moving a rod of the hydraulic actuator in one direction, a second position for stopping the rod of the hydraulic actuator, a third position for moving the hydraulic actuator rod at a high speed in the other direction with using a function of a regenerative circuit and a fourth position for moving the hydraulic actuator rod in the other direction at a standard speed without using the function of the regenerative circuit, in the mentioned order; and an operational mechanism for operating the four-position changeover control valve to either one of the first, second, third or fourth positions, the operational mechanism is adapted to be switched over between a three-position mode used when the first implement is mounted to the tractor and a four-position mode used when the second implement is mounted to the tractor, wherein the first implement comprises a front loader mounted to the tractor, the front loader having a bucket, and the hydraulic actuator of the first implement comprises a bucket actuator for effecting rolling back and dumping operations of said bucket, when the operational mechanism is switched over to the three-position mode, the bucket is operated through the bucket actuator by operating the four-position changeover control valve among the three positions consisting of the rollback position, the neutral position and the rapid dump position without using the standard dump position, and when the operational mechanism is switched over to the four-position mode, the second implement is operated with further using the fourth position of the operational mechanism.

7. The hydraulic control apparatus according to claim 6, wherein said operational mechanism includes a stopper plate for limiting the operational path of the mechanism to the rollback position, the neutral position and the rapid dump position when the operational mechanism is switched over to the three-position mode.

8. The hydraulic control apparatus according to claim 6, wherein the four-position changeover control valve has a detent mechanism for providing the operator with a distinct operational feel at the third position thereof, the detent mechanism including a recess defined in the spool and a ball urged to engage the recess.

* * * * *